US005335591A

United States Patent [19]

Pozar

[11] Patent Number: 5,335,591

[45] Date of Patent: Aug. 9, 1994

[54] TEA BAG SQUEEZER

[76] Inventor: Josef Pozar, 8902 W. Jewell Pl., Lakewood, Colo. 80227

[21] Appl. No.: 43,160

[22] Filed: May 28, 1993

Related U.S. Application Data

[63] Continuation-in-part of Ser. No. 972,107, Nov. 5, 1992, abandoned, which is a continuation-in-part of Ser. No. 861,137, Mar. 31, 1992, abandoned.

[51] Int. Cl.[5] ..... B30B 9/06

[52] U.S. Cl. ..... 100/116; D7/666; 99/287; 100/135; 100/234; 294/7; 294/118

[58] Field of Search ..... 100/104, 110, 116, 125, 100/135, 213, 234; 99/287; 294/7, 118; D7/666

[56] References Cited

U.S. PATENT DOCUMENTS

| | | | |
|---|---|---|---|
| 272,320 | 2/1883 | Ralston | 294/118 X |
| 782,406 | 2/1905 | Mayhew et al. | 100/135 X |
| 2,020,293 | 11/1935 | Adelstein | 100/234 X |
| 2,484,461 | 10/1949 | Perry, Jr. | 100/234 X |
| 2,708,401 | 5/1955 | Leclerc et al. | 100/234 |
| 2,829,588 | 4/1958 | Battke | 100/135 X |
| 2,887,948 | 5/1959 | Kramer et al. | 100/234 X |
| 3,342,518 | 9/1967 | Gorton, Jr. | 100/234 X |
| 4,002,365 | 1/1977 | Rader | 294/118 X |
| 4,286,514 | 9/1981 | Wilson | 100/234 X |
| 4,904,009 | 2/1990 | Kozlinski | 100/234 X |

FOREIGN PATENT DOCUMENTS

| | | | |
|---|---|---|---|
| 26097 | of 1902 | United Kingdom | 294/7 |

*Primary Examiner*—Stephen F. Gerrity
*Attorney, Agent, or Firm*—Ralph (Rick) M. Martin

[57] ABSTRACT

The invention is a tea bag or coffee bag squeezer that uses a pair of flat, opposed perforated plates in connection with a pair of pivotally mounted arms that pivot the plates together. The plates are of substantially flat construction and preferable made of perforated stainless steel.

9 Claims, 3 Drawing Sheets

TEA BAG SQUEEZER

CROSS-REFERENCES TO RELATED APPLICATIONS

This application is a continuation-in-part of U.S. Pat. application No. 07/972,107 filed Nov. 5, 1992, (abandoned) which is a continuation-in-part of U.S. Pat. application No. 07/861,137 filed Mar. 31, 1992(abandoned).

FIELD OF THE INVENTION

1. Background of the Invention

The invention relates to the field of utensils and in particular to a squeezing utensil that is primarily directed toward squeezing tea and coffee bags to quicken and strengthen the flavor of the tea and remove excess moisture from the tea bag.

2. Description of the Prior Art

While there are tea bag squeezers that are known, this inventor is unaware of any that use a pair of perforated plates, each of substantially flat construction.

SUMMARY OF THE INVENTION

The invention is a tea bag squeezer that uses a pair of opposed plates, each plate of which is mounted at the end of a lever. The levers are pivotally mounted, like a pair of scissors. The squeezer is applied to the tea bag before it is inserted in a cup of boiling water, and the handles are squeezed to apply pressure to the bag. When tea flavor is strong enough, the squeezer is removed with the tea bag from the cup. Then pressure is applied to remove excess moisture. This aids in preventing messiness and also in enhancing the strength of the tea. The plates are of substantially flat steel construction, and would preferably have a series of perforations in their surface.

The main object of the present invention is to provide a tea bag or coffee bag squeezer that can efficiently squeeze as much excess moisture out of the bag as possible.

Another object of the present invention is to provide a tea bag squeezer that allows excess moisture to go through the squeezing plates.

Yet another object is to provide a tea bag squeezer that will wring out excess moisture without harming the flavor of the tea.

Still yet another object of the present invention is to prevent a tea bag from tearing.

Other objects of this invention will appear from the following description and appended claims, reference being had to the accompanying drawings forming a pare of this specification wherein like reference characters designate corresponding parts in the several views.

DESCRIPTION OF THE PREFERRED EMBODIMENT

Figure 1:
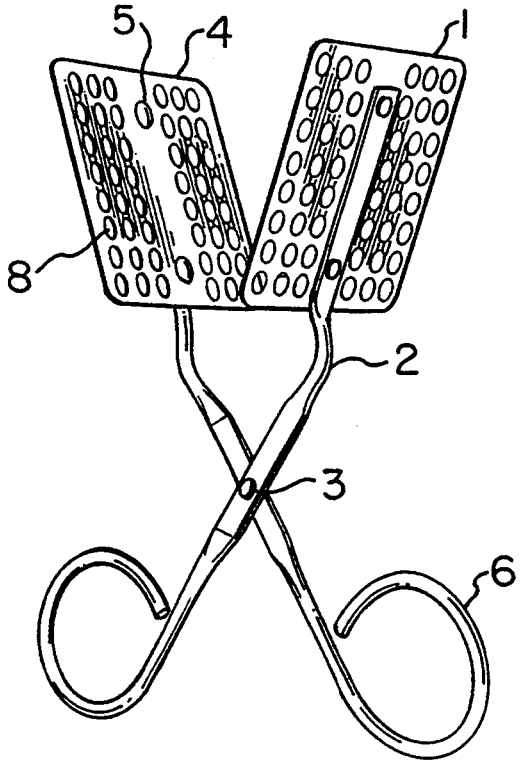
FIG. 1 is a front perspective view of a tea bag squeezer.

The tea bag squeezer of the present invention is constructed as shown in FIG. 1. A pair of opposed, substantially flat, metal plates 1,4 squeeze against a tea bag (not shown), thereby wringing out the excess moisture.

Each of the plates 1, 4 are mounted at one end of a lever means 2. The levers 2 are pivotally mounted in relation to each other like a pair of scissors. At the end of each lever 2, opposite the plate 1, 4, is a handle 6 for facilitating the squeezing action. The levers 2 are joined near their middle areas 3 with a rivet so that they may squeeze the plates 1, 4 together when pressure is applied at the handles.

The plates 1, 4, themselves are preferably made of stainless steel and are of substantially flat construction. That is to say that the plates 1, 4 should be made as flat as reasonably possible without having to go through the trouble of sophisticated metal working techniques. Generally available techniques should suffice to construct plates that are substantially flat. It is preferred that the plates be of substantially square shaped construction. The ends of the handles 6 should be joined to the plates 1, 4 at or near the center line of each plate. This connection 5 should be on the side opposite that side of the plates that contact each other so as not to interfere with the closing of the plates. The handles 6 should be pivotally connected to one another at a point 3 about midway along the handle 6 as shown in FIG. 1.

To use the squeezer, the tea or coffee bag is placed between the plates 1, 4 and inserted in a cup of boiling water. The handles are squeezed to apply pressure to the bag. When the flavor is strong enough the squeezer is removed with the bag held above the cup. Hard pressure is applied to squeeze as much moisture as possible out of the bag to prevent dripping.

Figure 2:
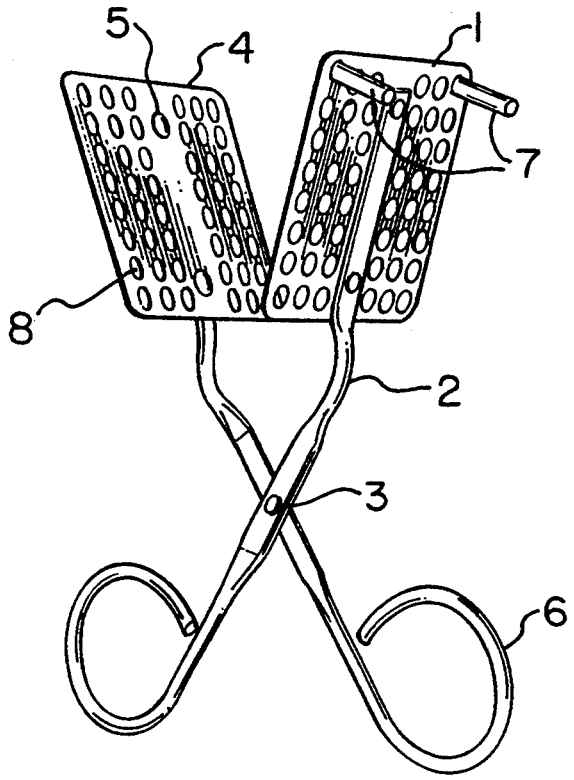
FIG. 2 is a front perspective view of a squeezer having legs.

An identical tea bag squeezer as in FIG. 1 is shown in FIG. 2, but a pair of leg portions 7 extend away from one of the plates 1. The leg portions 7 are, preferably, perpendicular to the plane of the plate t. They extend away from the backside of the plate, that is, the side of the plate that is away from the other opposing plate 4. This is so that the legs do not interfere with the closing of the plates. The plates will close as normal by squeezing on the handles.

The legs 7 should be about ¼–½" in length and have a diameter of 3/16". They should be made of stainless steel. It is preferred that the legs 7 be on opposite sides of the centerline 5 as shown in FIG. 2.

The use of the legs 7 allows the tea bag squeezer to rest on the two legs 7 as well as one of the handles 6. The tea bag squeezer can then be rested on these three points. This will prevent the tea bag, held between the plates, from staining the table cloth after the tea has been squeezed from it.

It is believed that using substantially flat plates will aid in the course of squeezing to insure that as great an amount of tea will be squeezed out of the bag as possible.

The plates would preferably be made of stainless steel although that is not necessary to the principle of using two substantially flat opposed plates for the squeezer. It is thought that the use of stainless steel is best as it will not detract from the flavor of the tea. Perforations 8 should also appear in the plates so as to aid in helping speed the process by allowing tea to channel through the tea bags as they are being squeezed. The squeezer may also be used to squeeze coffee bags.

The perforations 8 would preferably be about ⅛" to 3/16" in diameter and would substantially cover the area of the plates. The perforations could also be elongated slots of about ⅛" by ⅜" to allow substantially more hot water to flow through the plates for a quicker cup of tea or coffee.

Figure 3:
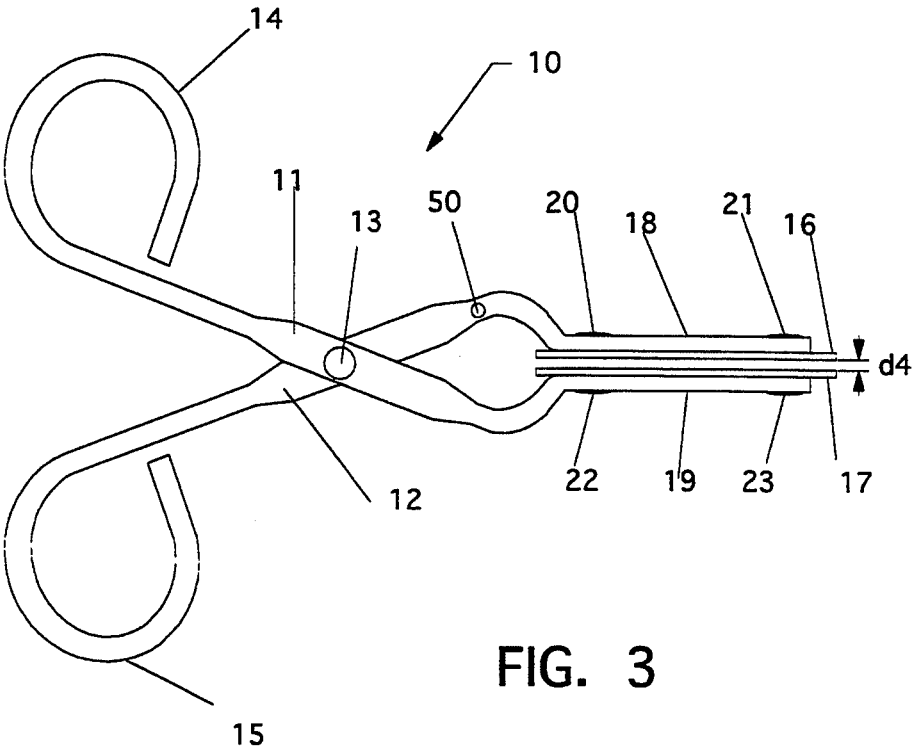
FIG. 3 is a side plan view of a tea bag squeezer.
Figure 4:
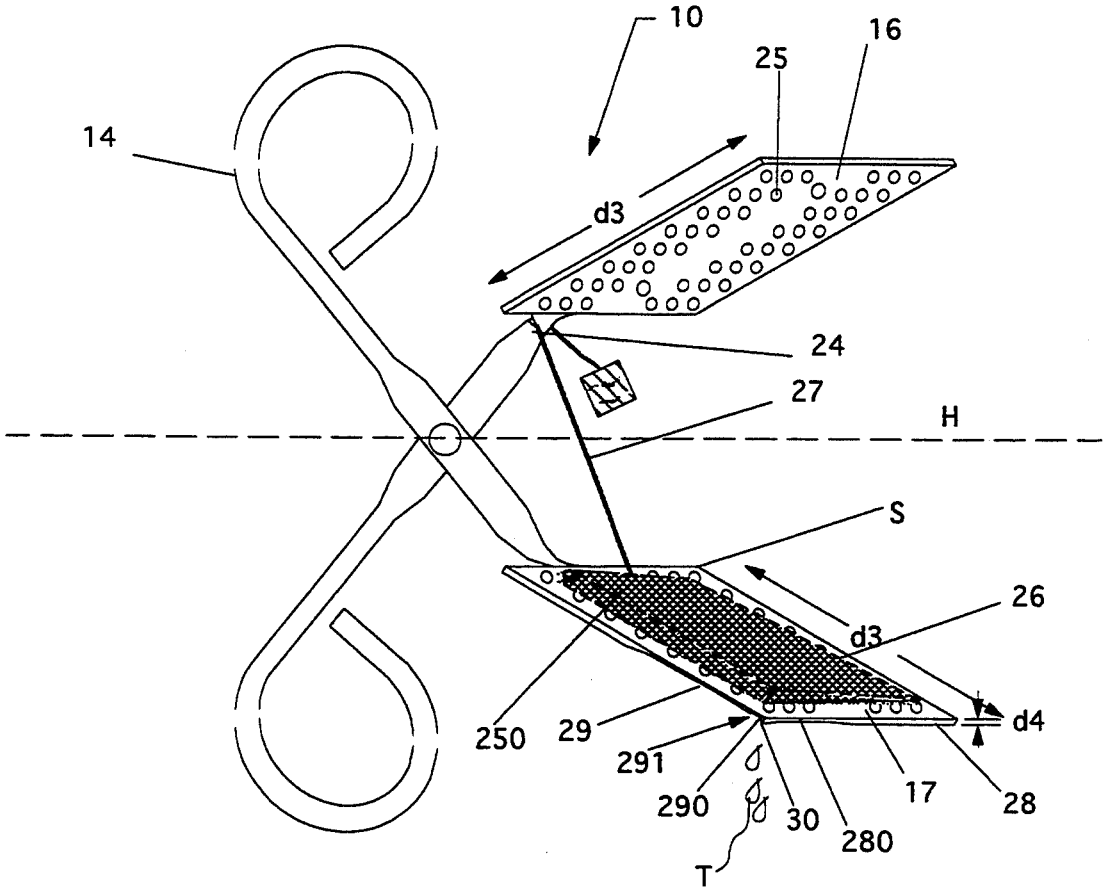
FIG. 4 is a side perspective view of the squeezer of FIG. 3 with a tea bag.

Referring next to FIG. 3 a squeezer 10 has lever arms 11, 12 pivotally connected by rivet 13. Handles 14, 15 may be pressed together thereby creating a squeezing pressure between squeeze plates 16, 17. Squeeze plates 16, 17 are attached to lever arm ends 18, 19 by means of rivets 20, 21, 22, 23. The location of rivet 13 is such that the squeeze plates 16, 17 are parallel at a separation distance d4 of about 0.125 inch. This is the thickness of a dry tea bag. A string rod 50 or a clip 24 as shown in FIG. 4 is used to secure a string of a tea bag (FIG. 4).

In operation a dry tea bag is placed between squeeze plates 16, 17 and the string 27 (FIG. 4) is secured to the string rod 50 or clip 24. Next, the tea bag is inserted into a cup of hot water. The handles 14, 15 are repeatedly squeezed and released until the desired strength of tea is obtained. Then the squeezer 10 is lifted out of the cup. The residual tea beverage is squeezed out of the tea bag. As shown in FIG. 4 a spout 30 allows the final drop of tea T to fall straight down in a controllable fashion into a cup.

This procedure is an improvement over the prior art because the dimensions of the squeeze plates are two inches by two inches. See d3 of FIG. 4. This is a size adequate to entirely cover all tea bags while at the same time fit into most cups. Also the hole density of 8×6 one eighth inch holes allows the maximal amount of water to drain from a tea bag without rupturing the thin skin of the tea bag with the squeezing pressure. See hole 25 of FIG. 4.

Known in the prior art are tweezer type tea bag squeezers which only cover half the tea bag. Thus, only half the resident tea is squeezed from the tea bag. Also the squeezers do not provide a lever fulcrum for maximum pressure nor do they provide parallel squeeze plates for consistent pressure across the tea bag.

Referring next to FIG. 4 squeezer 10 has been modified to exchange string rod 50 with clip 24 which serves the same purpose to secure the string 27. The Lipton ® tea bag 26 measures 1.5" Wide×2.25" Deep×0.125" Thick. Thus the squeeze plates 16, 17 cover substantially all the tea bag 26.

Furthermore, a drip spout 30 is formed by forward ridge 28 and side ridge 29. Also the front edge 280 and side edge 290 are curved downward from the horizontal H, thereby providing part of the structure of spout 30. Spout 30 allows hot tea drops T to pour into a cup when the squeezer 10 is held horizontally and squeezed. Without spout 30 the tea drops T would fall from holes 250 and sides S of the squeezer.

Figure 5:
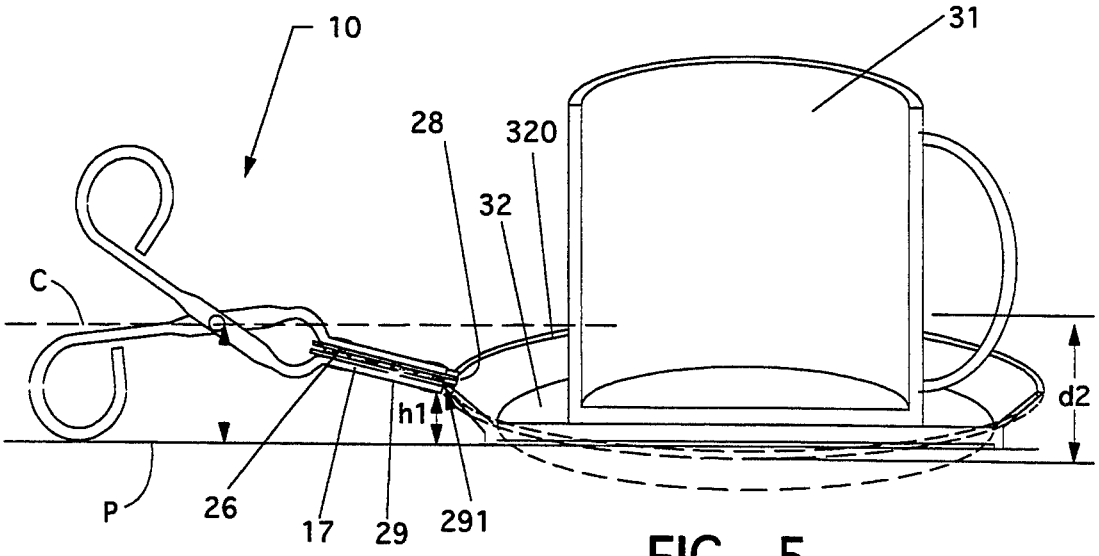
FIG. 5 is a side perspective view of a tea bag squeezer resting on a saucer.

Referring next to FIG. 5 squeezer 10 is shown resting on saucer 32 which holds tea cup 31. The width d3 of forward ridge 28 of two inches is considerably smaller than the diameter d2 of the saucer 32. Thus, the forward ridge 28 fits on saucer 32. Due to the design of handle 15 the height h2 of the centerline C of squeezer 10 to planer surface P is greater then the height h1 from the squeeze plate 17 to the planar surface P. Thus, any resident tea in the tea bag 26 drains into the saucer 32 and not the tablecloth (not shown) on planar surface P.

Forward ridge 28 prevents squeezer 10 from slipping off saucer lip 320. Notch 291 in side ridge 29 also helps prevent the squeezer 10 from slipping off the saucer lip 320.

Figure 6:
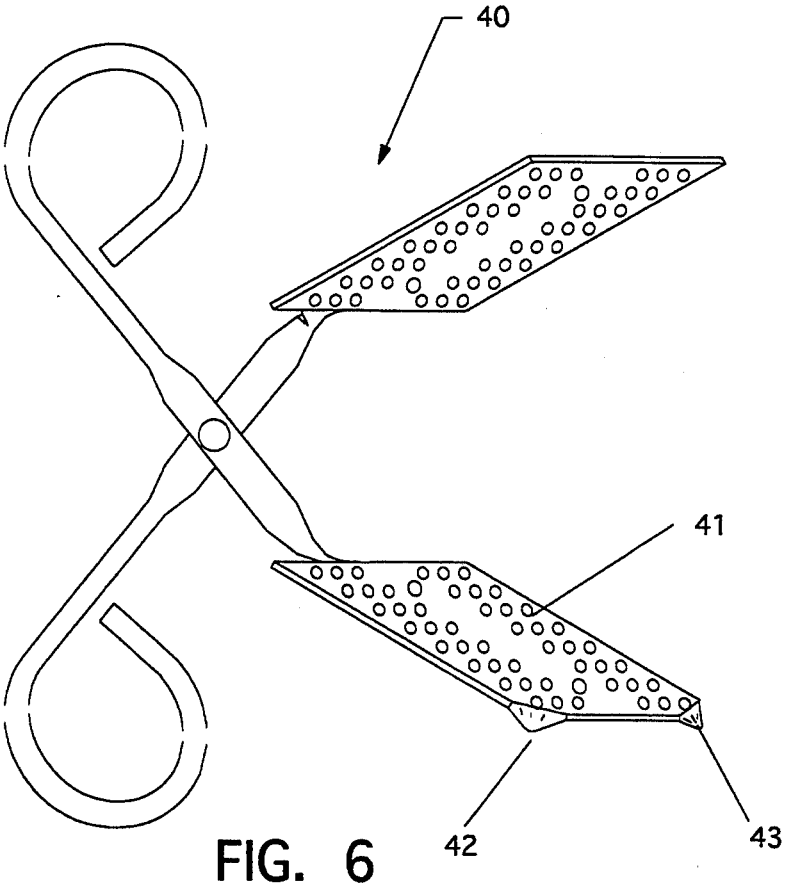
FIG. 6 is a side perspective view of a tea bag squeezer with risers.

Referring lastly to FIG. 6 an alternate embodiment squeezer 40 is shown. Squeezer plate 4! has risers 42, 43 made by bending the front edges of squeezer plate 41 down. Risers 42, 43 serve the same function as front ridge 28 in FIGS. 4,5. The function is to prevent squeezer 40 from slipping off a saucer and to hold the squeezer plate 41 off a tablecloth (not shown) to prevent staining.

It is known in the art that there exists equivalents tea bag 26 including but not limited to a coffee bag.

Although the present invention has been described with reference to preferred embodiments, numerous modifications and variations can be made and still the result will come within the scope of the invention. No limitation with respect to the specific embodiments disclosed herein is intended or should be inferred.

I claim:

1. Squeezers for handling and squeezing a tea bag in the hot water of a cup on a saucer, said squeezers comprising:

a pair of arms each having first and second ends;

said arms overlapping at a corresponding location between said first and second ends;

means pivotally connecting said arms together at said corresponding location;

said first arm ends being formed into oppositely extending cooperating handle means;

an upper and lower plate member approximately two inches square each having drainage holes wherein each member is connected to each arm at its second end;

said plate members further comprising a front, rear and side edges;

said squeezers having a closed position for gripping a tea bag wherein said upper and lower plate members spacedly overlie one another in a parallel generally superimposed orientation at a distance of approximately 0.125 inch and an open position;

said handle means for pivotally moving said arms about said pivot connecting means;

said lower plate member further comprising a spout, thereby allowing drainage therefrom from said tea bag during squeezing when said lower plate member is substantially parallel to the ground.

2. The squeezers of claim 1 wherein said spout further comprises a front and a side ridge on said lower plate member and a downward bend of the front side edges of said lower plate member into said spout.

3. The squeezers of claim 1 further comprising a means for securing a tea bag string on one of said arms.

4. The squeezers of claim 3 wherein said means for securing a tea bag string further comprises a clip.

5. The squeezers of claim 3 wherein said means for securing a tea bag string further comprises a rod.

6. The squeezers of claim 1 wherein said handle means further comprises a loop perpendicular to said plate members and having a diameter large enough to cause said lower plate member to be tilting downward toward its front edge when said squeezers are placed on said saucer.

7. The squeezers of claim 1 wherein said means for pivotally connecting said arms together further comprise a rivet.

8. Squeezers for handling and squeezing a tea bag in the hot water of a cup on a saucer, said squeezers comprising:

a pair of arms each having first and second ends;

said arms overlapping at a corresponding location between said first and second ends;

means pivotally connecting said arms together at said corresponding location;

said first arm ends being formed into oppositely extending cooperating handle means;

an upper and lower plate member approximately two inches square each having drainage holes wherein each member is connected to each arm at its second end;

said plate members further comprising a front, rear and side edges;

said squeezers having a closed tea bag gripping position wherein said upper and lower plate members spacedly overlie one another in a parallel generally superimposed orientation at a distance of approximately 0.125 inch and an open position; and said handle means for pivotally moving said arms about said pivot connecting means.

9. The squeezers of claim 8 wherein said lower plate member further comprises downwardly bent front edges forming risers.

* * * * *